United States Patent [19]

Moscatelli

[11] Patent Number: 5,042,955

[45] Date of Patent: Aug. 27, 1991

[54] DISPENSER WITH CLEANING CAP

[76] Inventor: Ernst Moscatelli, Sagenbachmatt 2, Hochdorf, Switzerland

[21] Appl. No.: 124,995

[22] PCT Filed: Mar. 4, 1987

[86] PCT No.: PCT/CH87/00024

§ 371 Date: Oct. 26, 1987

§ 102(e) Date: Oct. 26, 1987

[87] PCT Pub. No.: WO87/05195

PCT Pub. Date: Sep. 11, 1987

[30] Foreign Application Priority Data

Mar. 6, 1986 [CH] Switzerland ..... 1065/86

[51] Int. Cl.[5] ..... A46B 11/00

[52] U.S. Cl. ..... 401/269; 401/134; 401/173; 401/174

[58] Field of Search ..... 401/174, 176, 269, 173, 401/134, 269

[56] References Cited

U.S. PATENT DOCUMENTS

| | | | |
|---|---|---|---|
| 1,935,639 | 11/1933 | Keesham . | |
| 2,293,211 | 8/1942 | Mureau | 401/176 |
| 2,587,198 | 2/1952 | Mureau | 401/269 X |
| 2,673,362 | 3/1954 | Robinson | 401/269 X |
| 2,891,272 | 6/1959 | Wengeler et al. | 401/269 |
| 4,415,288 | 11/1983 | Gordon et al. | 401/134 X |

FOREIGN PATENT DOCUMENTS

| | | | |
|---|---|---|---|
| 1907973 | 9/1970 | Fed. Rep. of Germany . | |
| 3605506 | 8/1986 | Fed. Rep. of Germany . | |
| 3520523 | 12/1986 | Fed. Rep. of Germany . | |
| 960784 | 4/1950 | France | 401/269 |
| 966628 | 10/1950 | France | 401/176 |
| 979597 | 12/1950 | France | 401/173 |
| 2127644 | 10/1972 | France . | |
| 1277084 | 10/1981 | France . | |

*Primary Examiner*—Steven A. Bratlie

[57] ABSTRACT

The dispenser for applying lacquer, in particular nail-polish comprises a supply chamber, a brush and a dosing device for the adjustment of a flow speed and consequently the thickness of the layer. The brush is, when not used, surrounded by a sponge containing a cleaning fluid, in order to prevent the brush from drying out and getting sticky. The lacquer or nail-polish is hermetically enclosed, so that it remains liquid and does not change its color or viscosity.

10 Claims, 3 Drawing Sheets

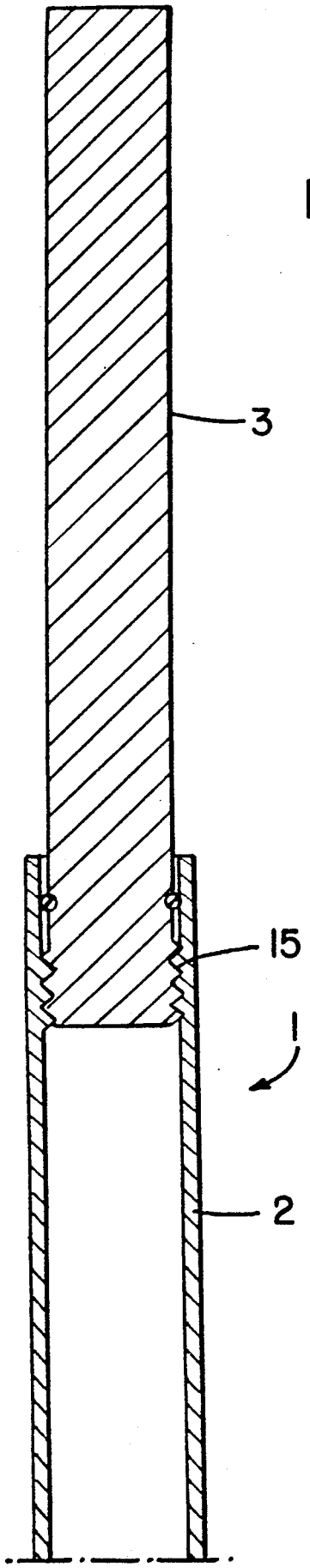
Fig. 3
Fig. 4
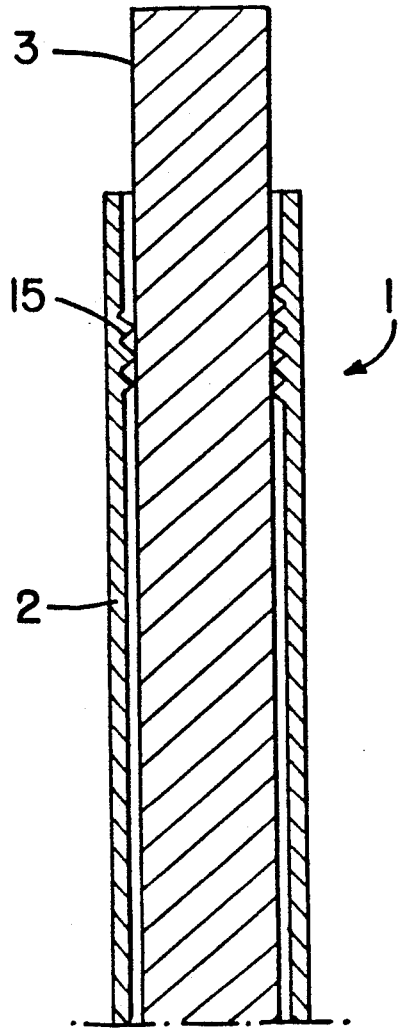

DISPENSER WITH CLEANING CAP

BACKGROUND OF THE INVENTION

The application relates to a dispenser with a supply chamber for applying lacquer, in particular nail-polish.

Such dispensers are primarily used for nail-enamel, nail-colors or nail-polish, but are suitable for other purposes as well, as for applying lacquer to spots on cars for example well as in chemical laboratories for tests and other uses. Generally spoken, such dispensers can be used for all lacquer applications in small quantities.

Normally nail-polish is applied to the nails from a bottle by means of a small brush, which is fastened onto the cover of the bottle. The brush is held by means of the cover, and the bottle is kept open during the application, causing the polish to dry out, in particular, if the work for some reason should be interrupted. However, since the brush is covered by the polish, when not used, the brush can not dry out and is always ready for use.

A disadvantage of this system is, that in addition to the sinking viscosity and change of color, the small bottle or container on e.g. a glass table may accidentally be swept away and the polish be spilled over clothing, furniture and carpet. The damage caused thereby may be very extensive, since such stains are very difficult, if not impossible, to remove.

In order to avoid these disadvantages, it has been suggested to replace the bottle with a brush in the cover with a highliter type of a dispenser, as used for marking text of a book or the like. The writing point of felt used on such devices is, however, not suitable for resin and lacquers, because it dries out very quickly.

Therefore, such a highliter type dipensers are practically not usable after a rather short period. Furthermore, felt is not at all as soft as a brush, so that the application of the polish by felt leaves a rather rough or uneven surface.

In the German published application No. 35 20 532 a writing device or dispenser for beauty fluids has been disclosed. This design has a thin brush suitable for application of eyeliners, but such brush is not sufficiently soft for the application of a nail-polish. The dispenser is rather complicated and has no means for preventing the access of air to the fluid supply chamber, so that in case of polish the latter may change its color and reduce its viscosity.

A further design has been disclosed in the German published specification No. 36 05 506, in which case an air access channel has been provided, for which reason the lacquer is apt to reduce its viscosity after a rather short period.

SUMMARY OF THE INVENTION

An object of the invention is, therefore, to develop a dispenser with supply chamber for applying lacquer, in particular nail-polish, by which dispenser the disadvantages of the prior art will be eliminated.

The advantages of the nail-polish dispenser according to the invention are as follows:

The dispenser is equipped with a soft brush suitable for applying a nail-polish, that has to be ready for use at any time.

When the supply chamber is empty, it can be easily refillable, if required.

During the application, the nail-polish is protected from access by the surrounding air, so that an early dry-out or change of color can be prevented.

The dispenser has to be portable in a lady's handbag, without any danger of leakage at normal temperatures.

Briefly, in accordance with the present invention, a lacquer dispenser is provided, which includes a cap filled with a sponge saturated with a chemical cleaning solution and connected to the dispenser when not in use so that the brush is immersed in the sponge and is prevented from drying out.

The dispenser described above has proved to serve the purpose very well, since the bristles of the brush are always soft and applicable, so that no further cleaning has been necessary. Since the dispenser can be refilled, it is possible to produce luxury types of the dispenser for a longer service time. The dispenser can be refilled either by cartridges or by pouring the nail polish from a bottle. If required, it is also possible to replace the brush with a holder or a cleaning fluid container.

The dispenser according to the invention, contrary to the known dispensers comprising a bottle and a brush fastened onto its cover, is suitable for use on travels and in-between travels or in restaurants. The dispenser can be applied by using one hand only, as is the case with a fountain pen, for example.

Since the supply chamber is entirely closed, air flow to the polish is prevented. Therefore, nail-polish contained in the supply chamber has a much longer service time, than one in a bottle. Also, the nail-polish maintains its viscosity and color for a longer duration.

BRIEF DESCRIPTION OF THE DRAWING

FIGS. 3 and 4 are partial sectional views of the dispenser of another embodiment of the invention.

DETAILED DESCRIPTION OF THE PREFERRED EMBODIMENT

Figure 1:
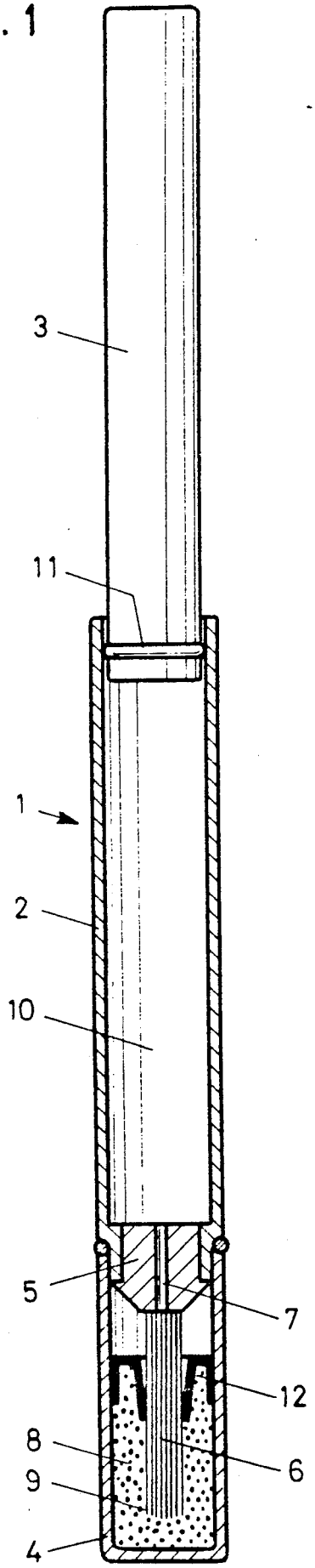
FIG. 1 shows a longitudinal section of a dispenser according to the invention, with a piston in the outward position.
Figure 2:
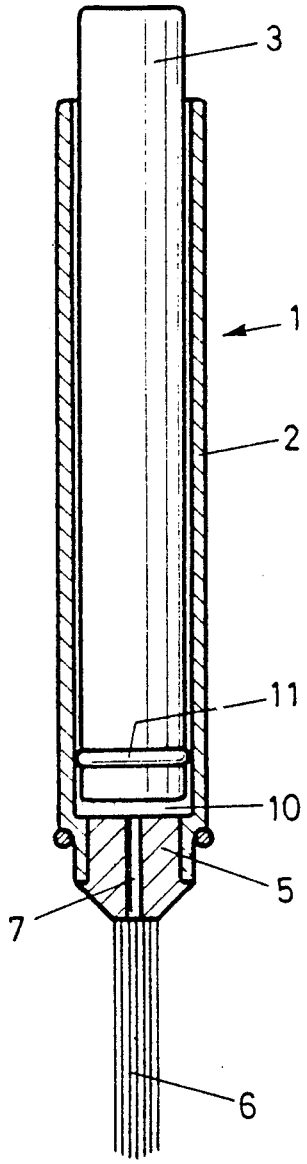
FIG. 2 shows a section according to FIG. 1 but with the piston in the inward position, and without a cleaning fluid cover.
Figure 5:
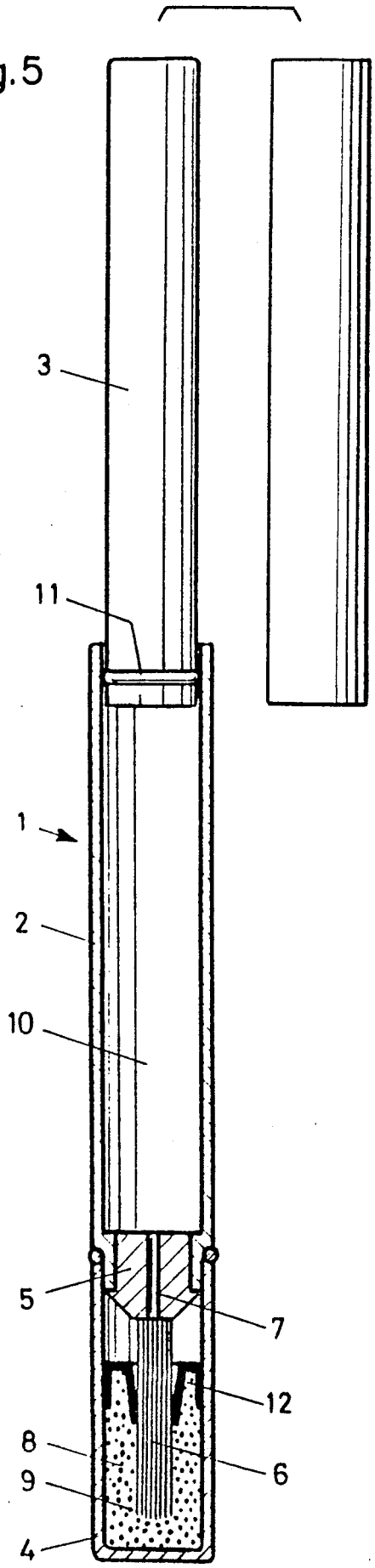
FIGS. 5 and 6 show axial sectional views of the dispenser of yet another embodiment.
Figure 6:
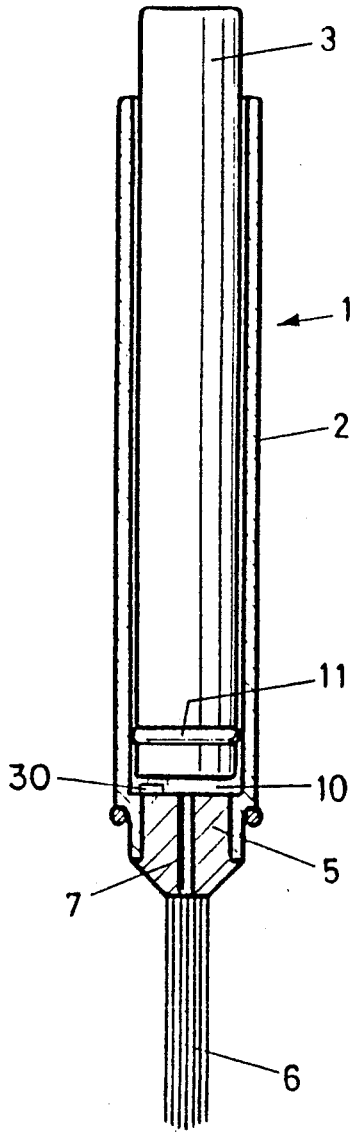

FIGS. 1 and 2 show a dispenser 1 with a cover 4 and a piston 3, which is movable in the longitudinal direction of the cylinder 2. The cylinder 2 can be provided with an interior thread 15, which engage a corresponding thread on the outside of the piston 3 as shown in FIGS. 3 and 4. Instead of the threads, the piston can be provided with an O-ring 11, as shown in FIGS. 5 and 6. The O-ring 11 serves as a gasket against the inner wall of the cylinder 2 and, therefore, firstly packs the piston 3 against the cylinder 2 and secondly keeps the piston 3 in an adjusted position. If the piston 3 is entirely pushed or screwed in, nail polish has to be added. This can either be done by pouring polish from a bottle or by inserting a cartridge, not shown. In both cases the piston 3 has to be pulled or screwed out.

By moving the piston 3, the pressure on the nail-polish can be adjusted, i.e. increased or reduced, in order to change the flow speed of the polish, or to influence the thickness of the layer.

In order to prevent, that the piston 3 is drawn out unintensionally, so that the polish may escape, a locking device 2D is located between the outer edge of the cylinder 2 and the inner portion of the piston 3. This locking device can be overcome by using force only.

In the case, that a cartridge is 25 (FIG. 5) used as a refill, means for opening the cartridge, such as a blade or some other cutting device 30 (FIG. 6) may be installed in the bottom of the cylinder 2.

At the inner end of the cylinder 2, a molded body 5 with a longitudinal channel 7 formed therethrough is mounted, around which the bristles of a brush 6 are fastened. The channel 7 serves to supply a nail-polish to the brush 6.

The cover 4 is somewhat thimble-shaped and has in its interior a sponge 8 for receiving a cleaning fluid 9 for the brush 6, so that it is always ready for the nail-polish application. Near to the receiving surface for the molded body 5, the sponge 8 is provided with a fluid cover or guide 12 for holding the sponge 8 and possibly for guiding the brush 6, so that it is guided into the middle of the sponge 8 and does not stick with bent bristles.

The cleaning fluid 9 consists e.g. of an acetone or a glycol derivate mixture. The inner end of the sponge 8 can be provided with a hollow space for receiving a supply of cleaning fluid 9, the fluid cover 12 can be shaped to reduce the dissipation of the fluid 9 to a minimum.

The cover 4 with its content can be supplied separately for more exclusive designs and can be replaced as desired. It can be fastened onto the cylinder by means of a thread or by a snap action.

In order to prevent a flow of the nail-polish to the brush 9, the channel 7 can be closed on the inside of the cylinder 2 e.g. by means of two engaging conic surfaces held at a distance by a spring and brought together by means of pressure in the longitudinal direction of the dispenser, and can be kept in a compressed position by means of a snap-lock.

In order that the operation of the dispenser be facilitated and its appearance be improved, the cylinder can be provided with a stylish and handy form in suitable colors.

Contrary to the known dispenser already referred to, the present design has been developed especially for resin and nail-polish. For this reason it has been necessary to simplify the design. In addition, it has been necessary to adjust the dimension of the flow channel to meet the lacquer requirements.

The efforts have resulted in a new type of nail-polish diepenser, that has proved to be dependable and long lasting.

I claim:

1. Dispenser for applying lacquers, particularly nail polish, comprising container means defining a lacquer supply chamber; a brush; means for fastening said brush to said container means; dosing means for the lacquer connecting said supply chamber with said brush; cap means removably connectable to said container means and defining a cleaning chamber; and cleaning means saturated with cleaning fluid and filling said cleaning chamber, said cap means being formed so that said brush is immersed in said cleaning means when said cap means is connected to said container means and the dispenser is not in use and said brush is released from said cleaning means when said cap means is removed from said container means, said fastening means including a molded body inserted in said container means and having a central channel connecting said supply chamber to the brush and holding bristles of said brush around said channel.

2. Dispenser as in claim 1, wherein said cleaning means includes a sponge containing said cleaning fluid which prevents the brush from drying out and becoming sticky.

3. Dispenser as in claim 1, wherein said dosing means includes a piston movable in said supply chamber for adjusting a flow speed of the lacquer applied.

4. Dispenser as in claim 3, further including locking means between said piston and an inner wall of said container means, said locking means exerting a locking force which can be overcome by user's force only.

5. Dispenser as in claim 3, further including means for adjusting pressure on a lacquer flow supplied to the brush from the supply chamber.

6. Dispenser as in claim 5, wherein said adjusting means includes an external thread on said piston and an internal thread on said container means cooperating with said external thread.

7. Dispenser as in claim 5, wherein said adjusting means includes an O-ring which defines an adjusted position of said piston in said supply chamber.

8. Dispenser as in claim 1, further including a cartridge filled with the lacquer and insertable into said supply chamber.

9. Dispenser as in claim 8, further including cutting means to open said cartridge.

10. Dispenser as in claim 1, wherein said container means is refillable.

* * * * *